US005421920A

United States Patent [19]

Yamamoto et al.

[11] Patent Number: 5,421,920

[45] Date of Patent: Jun. 6, 1995

[54] PROCESS FOR PRODUCING ROLLED SHAPE STEEL MATERIAL HAVING HIGH STRENGTH, HIGH TOUGHNESS, AND EXCELLENT FIRE RESISTANCE

[75] Inventors: Kohichi Yamamoto; Suguru Yoshida; Kazuo Watanabe, all of Sakai, Japan

[73] Assignee: Nippon Steel Corporation, Tokyo, Japan

[21] Appl. No.: 124,097

[22] Filed: Sep. 20, 1993

[30] Foreign Application Priority Data

Sep. 24, 1992 [JP] Japan ..... 4-254941

[51] Int. Cl.[6] ..... C22C 38/00

[52] U.S. Cl. ..... 148/546; 148/507; 148/652; 148/653; 148/654

[58] Field of Search ..... 148/546, 654, 652, 653, 148/507

[56] References Cited

U.S. PATENT DOCUMENTS

| | | | |
|---|---|---|---|
| 4,946,516 | 8/1990 | Yano et al. | 148/546 |
| 4,990,196 | 2/1991 | Tamehiro et al. | 148/12.4 |

FOREIGN PATENT DOCUMENTS

| | | | |
|---|---|---|---|
| 0117851 | 4/1986 | European Pat. Off. . | |
| 0347156 | 12/1989 | European Pat. Off. . | |
| 0462783 | 12/1991 | European Pat. Off. . | |
| 61-207512 | 9/1986 | Japan | 148/546 |
| 2-77523A | 3/1990 | Japan . | |
| 2-175815 | 7/1990 | Japan | 148/507 |
| 2-236228 | 9/1990 | Japan | 148/546 |
| 3-202422 | 9/1991 | Japan | 148/546 |
| 3-236419 | 10/1991 | Japan | 148/507 |
| 3-249128 | 11/1991 | Japan | 148/546 |
| 5-132716 | 5/1993 | Japan | 148/546 |

OTHER PUBLICATIONS

Patent Abstracts of Japan, vol. 16, No. 304 (C-959) Jul. 6, 1992 (JP-A-4-83821).

Data Base WPI, Section Ch, Week 9041, Derwent Publications Ltd., Class M22, AN 90-309984, corresponding JP-A-2-220735, Sep. 3, 1990.

Patent Abstracts of Japan, vol. 14, No. 470 (C-769) Oct. 15, 1990 (JP-A-2-194115).

Patent Abstracts of Japan, vol. 14, No. 342 (C-743) Jul. 24, 1990 (JP-A-2-125812).

European Search Report EP 93 11 5211.

A Newly Developed Ti-Oxide Bearing Steel Having High Haz Toughness, Nov. 1989, ASTM STP 1042, K. Yamamoto, S. Matsuda, T. Haze, R. Chijiiwa, and H. Mimura, pp. 266-284, A. S. Melilli and E. G. Nisbett, Eds., American Society for Testing and Materials, 1989.

Non-metallic inclusions in ferritic steel weld metals—a review, D. J. Abson (UK), Welding in the World, vol. 27, No. 3/4 (1989), pp. 11-28.

*Primary Examiner*—Richard O. Dean
*Assistant Examiner*—Sikyin Ip
*Attorney, Agent, or Firm*—Kenyon & Kenyon

[57] ABSTRACT

After a predeoxidation treatment of a molten steel comprising as basic ingredients, in terms of % by weight, 0.04 to 0.20% of C, 0.05 to 0.50% of Si, 0.4 to 2.0% of Mn, 0.3 to 0.7% of Mo, 0.003 to 0.015% of N, 0.04 to 0.20% of V and less than 0.005% of Al to regulate [O %] to 0.003 to 0.015% by weight, titanium is added thereto so as to satisfy a requirement represented by the formula: $-0.006 \leqq [Ti\ \%]-2[O\ \%] \leqq 0.008$ to crystallize a titanium-based oxide in an amount of 20 particles/mm$^2$ or more, and MnS, TiN and V(C, N) are deposited on the titanium-based oxide to disperse the titanium-based oxide as a composite precipitate in the steel to provide a cast slab, and a high-strength high-toughness shape steel having an excellent fire resistance is provided by a combination of water cooling between rolling passes at the time of rolling with accelerated cooling after the completion of the rolling.

2 Claims, 5 Drawing Sheets

×200

×200

[SIZE : H900 × 300 × 16/28, AS ROLLED, 1/2 F]

PROCESS FOR PRODUCING ROLLED SHAPE STEEL MATERIAL HAVING HIGH STRENGTH, HIGH TOUGHNESS, AND EXCELLENT FIRE RESISTANCE

TECHNICAL FIELD

The present invention relates to a controlled rolled shape steel having a high strength, a high toughness and an excellent fire resistance, for use as a structural member for construction, and particularly to a controlled rolled shape steel produced by a process wherein a molten steel is subjected to a predeoxidation treatment to accelerate the formation of an intragranular ferrite and rolling is effected while controlling the temperature.

BACKGROUND ART

The Ministry of Construction has reconsidered the fire-resistant design of buildings due to a significant increase in the height of new buildings, and advances in architectural design technique, etc., and the ∂New Fire-Resistant Design Law" was enacted in March, 1987. In the new Law, the limitation under the old Law that fireproofing should be provided so that the temperature of steel products during a fire is kept below 350° C. has been removed, and it has become possible to determine a suitable fireproofing method depending upon a balance between the high-temperature strength of steel products and the actual load of building. Specifically, when the design high-temperature strength at 600° C. can be ensured, the fireproofing can be reduced accordingly.

In order to cope with this trend, Japanese Unexamined Patent Publication (Kokai) No. 2-77523 proposes low yield ratio steels and steel products having excellent fire resistance for use in buildings and a process for producing the same. The subject matter of this prior application is that a high-temperature strength is improved by adding Mo and Nb in such an amount that the yield point at 600° C. is 70% or more of the yield point at room temperature. The design high-temperature strength of the steel product has been set to 600° C. based on the finding that this is most profitable in view of the balance between the increase in the steel production cost due to alloying elements and the cost of executing the fireproofing.

In the Al deoxidation of the steel in the prior art, Al has been added in an early stage of the production of a steel, by the melt process, to effect deoxidation and floatation separation of the resultant $Al_2O_3$, thereby purifying the molten steel. In other words, the subject matter was how to lower the oxygen concentration of the molten steel and to reduce the oxide as the product of the primary deoxidation.

The concept of the present invention is different from that of the above-described prior art. Specifically, the present invention is characterized in that Ti is added, the amount of Al and oxygen is restricted, and a fine compound oxide, useful as an intragranular ferrite transformation nucleus, is precipitated by regulating the deoxidation process.

The present inventors have applied the steel produced by the above-described prior art technique to materials for shape steels, particularly an H-shape steel strictly restricted by roll shaping due to a complicated shape and, as a result, have found that the difference in the roll finishing temperature, reduction ratio and cooling rate between sites of a web, a flange and a fillet causes the structure to become remarkably different from site to site, so that the strength at room temperature, strength at a high temperature, ductility and toughness vary and some sites do not satisfy the JIS G3106 requirements for rolled steels for welded structures.

In order to solve the above-described problem, it is necessary to attain a refinement of the microstructure through the device of steel making and rolling processes and provide a process for producing a controlled rolled shape steel having excellent material properties, fire resistance and toughness at low cost with high profitability.

DISCLOSURE OF THE INVENTION

In the present invention, the above-described problem can be solved by refinement of the microstructure attained by a method wherein a proper Ti deoxidation treatment is effected, instead of the Al deoxidation, to disperse a fine titanium-based compound oxide in an amount of 20 particles/mm$^2$ or more in the steel, so that an intragranular ferrite (hereinafter referred to as "IGF") can be produced from within the austenite grains even under the above-described rolling conditions inherent in shape steel materials; and, further, by refinement of the microstructure and an increase in the efficiency of controlled rolling (TMCP) by virtue of a rolling penetration effect derived from water cooling between passes during rolling. The subject matter of present invention is as follows:

① A cast slab produced by subjecting a molten steel comprising, in terms of % by weight, 0.04 to 0.20% of C, 0.05 to 0.50% of Si, 0.4 to 2.0% of Mn, 0.3 to 0.7% of Mo, 0.003 to 0.015% of N, 0.04 to 0.20% of V and less than 0.005% of Al, with the balance consisting of Fe and unavoidable impurities, to a predeoxidation treatment to regulate the dissolved oxygen concentration to 0.003 to 0.015% by weight, adding titanium so as to produce a titanium content of 0.005 to 0.025% by weight and to satisfy a requirement of the relationship between the titanium content [Ti %] and the dissolved oxygen concentration [O %], represented by the formula: $-0.0006 \leqq [Ti\ \%]-2[O\ \%] \leqq 0.008$, to crystallize a titanium-based oxide in an amount of 20 particles/mm$^2$ or more and depositing MnS, TiN and V(C, N) on the titanium-based oxide, during cooling, to disperse the titanium-based oxide as a composite precipitate in the steel.

② A cast slab produced by subjecting a molten steel comprising, in terms of % by weight, 0.04 to 0.20% of C, 0.05 to 0.50% of Si, 0.4 to 2.0% of Mn, 0.3 to 0.7% of Mo, 0.003 to 0.015% of N, 0.04 to 0.20% of V and less than 0.005% of Al and further comprising at least one member selected from 0.7% or less of Cr, 0.05% or less of Nb, 1.0% or less of Ni, 1.0% or less of Cu, 0.003% or less of Ca and 0.010% or less of REM(Rare earth metal) with the balance consisting of Fe and unavoidable impurities, to a predeoxidation treatment to regulate the dissolved oxygen concentration to 0.003 to 0.015% by weight, adding titanium so as to produce a titanium content of 0.005 to 0.025% by weight and to satisfy a requirement of the relationship between the titanium content [Ti %] and the dissolved oxygen concentration [O %] represented by the formula:

$-0.006 \leqq [Ti\ \%] - 2[O\ \%] \leqq 0.008$, to crystallize a titanium-based oxide in an amount of 20 particles/mm$^2$ or more and depositing MnS, TiN and V(C, N) on the titanium-based oxide, during cooling, to disperse the titanium-based oxide as a composite precipitate in the steel.

(3) A process for producing a controlled rolling shape steel, having excellent fire resistance and toughness, comprising the steps of: subjecting a molten steel comprising, in terms of % by weight, 0.04 to 0.20% of C, 0.05 to 0.50% of Si, 0.4 to 2.0% of Mn, 0.3 to 0.7% of Mo, 0.003 to 0.015% of N, 0.04 to 0.20% of V and less than 0.005% of Al with the balance consisting of Fe and unavoidable impurities, to a predeoxidation treatment to regulate the dissolved oxygen concentration to 0.003 to 0.015% by weight, adding titanium so as to produce a titanium content of 0.005 to 0.025% by weight and to satisfy a requirement of the relationship between the titanium content and the dissolved oxygen concentration O %] represented by the formula: $-0.006 \leqq [Ti\ \%] - 2[O\ \%] \leqq 0.008$ to crystallize a titanium-based oxide in an amount of 20 particles/mm$^2$ or more, depositing MnS, TiN and V(C, N) on the titanium-based oxide, during cooling, to disperse the titanium-based oxide as a composite precipitate in the steel, thereby producing a cast slab, reheating the cast slab to a temperature region of from 1,100° to 1,300° C., then initiating rolling, effecting between passes in the step of rolling at least once water-cooling of the surface layer portion of the resultant steel slab to 700° C. or below followed by rolling in the process of recurrence of the surface of the steel, cooling the rolled steel after the completion of the rolling at a cooling rate of 1 to 30° C./sec to 650° to 400° C. and then allowing the cooled steel to stand.

(4) A process for producing a controlled rolling shape steel, having excellent fire resistance and toughness, comprising the steps of: subjecting a molten steel comprising, in terms of % by weight, 0.04 to 0.20% of C, 0.05 to 0.50% of Si, 0.4 to 2.0% of Mn, 0.3 to 0.7% of Mo, 0.003 to 0.015% of N, 0.04 to 0.20% of V and less than 0.005% of Al and further comprising at least one member selected from 0.7% or less of Cr, 0.05% or less of Nb, 1.0% or less of Ni, 1.0% or less of Cu, 0.003% or less of Ca and 0.010% or less of REM, with the balance consisting of Fe and unavoidable impurities, to a predeoxidation treatment to regulate the dissolved oxygen concentration to 0.003 to 0.015% by weight, adding titanium so as to produce a titanium content of 0.005 to 0.025% by weight and to satisfy a requirement of the relationship between the titanium content [Ti %] and the dissolved oxygen concentration [O %], represented by the formula: $-0.006 \leqq [Ti\ \%] - 2[O\ \%]$, 0.008, to crystallize a titanium-based oxide in an amount of 20 particles/mm$^2$ or more, depositing MnS, TiN and V(C, N) on the titanium-based oxide during cooling to disperse the titanium-based oxide as a composite precipitate in the steel, thereby producing a cast slab, reheating the cast slab to a temperature region of from 1,100° to 1,300° C., then initiating rolling, effecting between passes in the step of rolling at least once water-cooling of the surface layer portion of the resultant steel slab to 700° C. or below followed by rolling in the process of recurrence of the surface of the steel, cooling the rolled steel after the completion of the rolling at a cooling rate of 1° to 30° C./sec to 650° to 400° C. and then allowing the cooled steel to stand.

BEST MODE FOR CARRYING OUT THE INVENTION

The best mode for carrying out the invention will now be described in detail.

Figure 1:
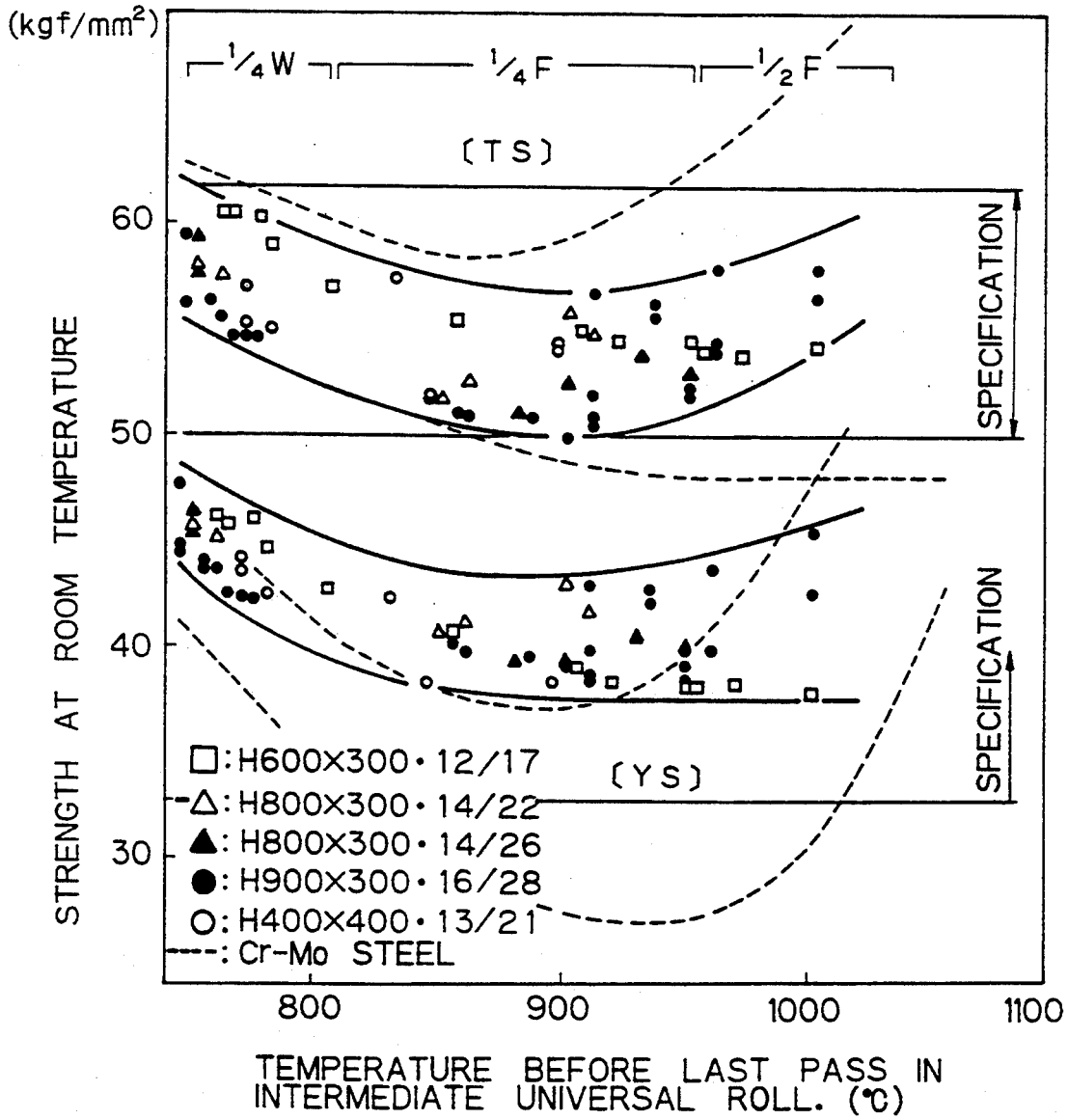
FIG. 1 is a diagram showing the influence of the roll finishing temperature on the tensile strength at each site for the conventional refractory H-shape steel and the H-shape steel of the present invention.

The strengthening mechanism in the high-temperature strength of a steel product at a temperature of 700° C. or below, which is about ½ of the melting point of iron, is substantially the same as that at room temperature and governed by (1) refinement of ferrite grains, (2) solid solution strengthening by alloying elements, (3) dispersion strengthening by a hard phase, (4) precipitation strengthening by fine precipitates, etc. In general, an increase in the high-temperature strength has been attained by precipitation strengthening through the addition of Mo or Cr and an enhancement in the softening resistance at a high temperature through the elimination or suppression of dislocations. The addition of Mo and Cr, however, gives rise to a remarkable increase in the hardenability and converts the (ferrite+pearlite) structure of the base material to a bainite structure. When a steel comprising ingredients, which can easily form a bainite structure, is applied to a rolled shape, the peculiar shape gives rise to a difference in the roll finishing temperature, reduction ratio and cooling rate between sites of a web, a flange and a fillet, so that there is a large variation in the proportion of the bainite structure from site to site. As a result, the strength at room temperature, strength at a high temperature, ductility and toughness vary from site to site and some sites do not satisfy the requirements for rolled steels for welded structures. For example, as indicated by a dotted line in FIG. 1 showing the strength of a 490N-class steel, the tensile strength varies according to the difference in the roll finishing temperature between sites. The fillet portion is subjected to high-temperature roll finishing at a temperature 100° to 150° C. above that of the web which causes $\gamma$ to be coarsened, and enhances the hardenability, so that the bainite structure is increased, thus resulting in a significant increase in the strength. On the other hand, since the web is subjected to low-temperature finishing, $\gamma$ is refined and the hardenability lowers, so that a mixed structure comprising fine grain ferrite and bainite is formed, which provides a suitable strength. In an intermediate finishing temperature region corresponding to the flange portion, although a mixed structure comprising ferrite and bainite is formed, since the ferrite is in a relatively coarse grain form, the strength falls. Specifically, since the roll finishing temperature differs depending upon sites the H-shape steel, the $\gamma$ grain diameter varies from site to site, which has an influence on the hardenability, so that the proportion of bainite and ferrite grain diameters vary from site to site. The difference in structure between sites gives rise to scattering in toughness. Further, the addition of Mo indispensable for ensuring the high-temperature strength causes a weld heat affected zone to be significantly hardened, and lowers the toughness of the zone.

A feature of the present invention is that, in the steel, compound oxide particles comprising Ti as a main component and Mn, Si, Al, Ca, Mg and REM elements are precipitated in a dispersed state by a combination of the regulation of the dissolved oxygen concentration of the molten steel with the procedure of addition of Ti as a deoxidizing element immediately before tapping, and MnS, TiN and V(C, N) are crystallized in the form of a composite comprising the compound oxide particles as nuclei. A further feature of the present invention is that an intragranular ferrite is nucleated within from austenite grains during hot rolling using the above-described composite precipitate as a nucleus to provide an intragranular ferrite, thereby reducing the difference in the proportions of bainite and ferrite structures between sites of an H-shape steel, caused by the difference in the finishing temperature and cooling rate between the sites and refining the ferrite grains to attain improvement and homogenization of mechanical properties of the base material. The high-temperature strength is enhanced by virtue of precipitation strengthening of carbonitride of V.

Figure 2:
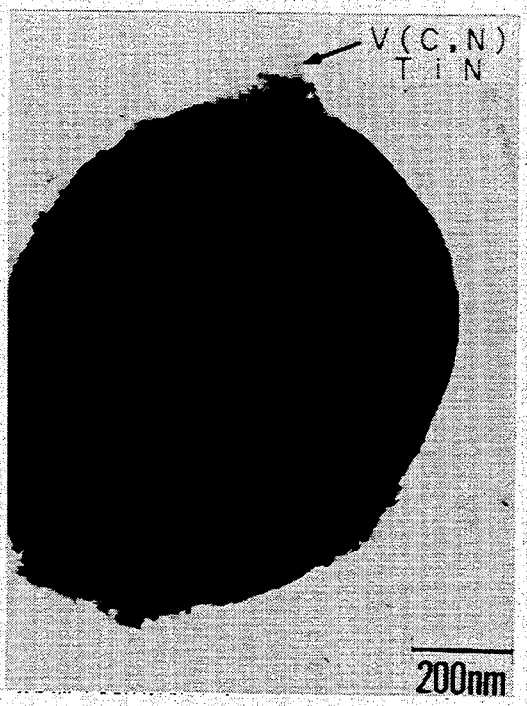
FIG. 2 is a diagram showing a transmission electron photomicrograph of an extraction replica of a composite precipitate wherein an intragranular ferrite has been nucleated in the refractory shape steel of the present invention.
Figure 3:
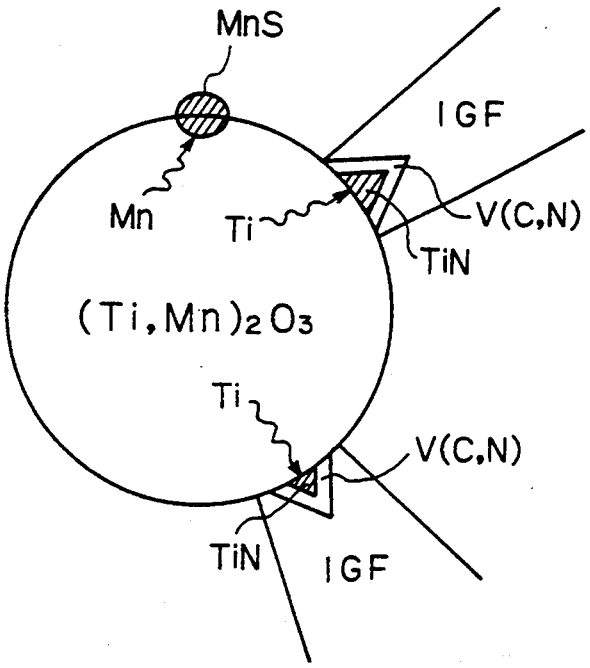
FIG. 3 is a schematic diagram showing a nucleation mechanism for an intragranular ferrite in the refractory shape steel of the present invention.
Figure 4A:
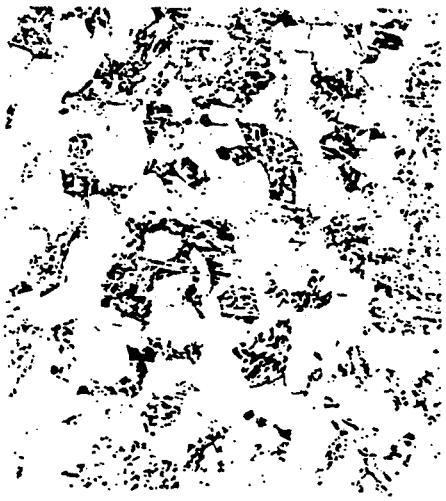
FIG. 4 is a diagram showing a difference in the microstructure of a fillet portion (½F portion) observed under a microscope between the refractory H-shape steel of the present invention, FIG. 4*a* and the conventional refractory H-shape steel, FIG. 4*b;*
Figure 4B:
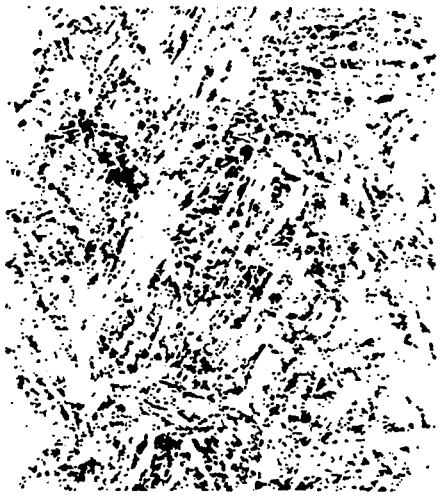

The way in which the crystallized Ti-based compound oxide effectively acts on the formation of the intragranular ferrite will now be described. The Ti-based compound oxide is composed mainly of $Ti_2O_3$ and is in the form of a crystal containing a number of cation holes. In a $\gamma$ temperature region in the course of heating and cooling, $Ti_2O_3$ diffuses Ti, Mn, etc. through the inherent cation holes from within grains to the outer shell where the diffused Ti and Mn combine with S and N dissolved in a solid solution form in the matrix phase, which causes MnS and TiN to preferentially precipitate. A lowering in the temperature by further cooling causes V(C, N) to be preferentially precipitated on TiN deposited on $Ti_2O_3$. The precipitated V(C, N) is highly coherent in terms of crystal lattice with $\alpha$, reduces the surface energy at the V(C, N)/$\alpha$ interface produced by the formation of a $\gamma/\alpha$ nucleus and accelerates the formation of an $\alpha$ nucleus. Preferential precipitation of V(C, N) on TiN is attributable to the relationship between TiN and V (C, N) in that they are dissolved, in a solid solution form, in each other in any ratio. FIG. 2 is an electron photomicrograph (a TEM image) of a precipitate wherein an intragranular ferrite has been actually nucleated. The precipitation and $\alpha$ transformation mechanisms are schematically shown in FIG. 3. The present invention has been made based on the above-described novel finding, and the dependence of the tensile strength upon the roll finishing temperature (difference between sites of H-shape steel) for the steel of the present invention and conventional steel is shown in FIG. 1. Thus, in the steel of the present invention, the dependence of the mechanical properties upon the finishing temperature is so low that the mechanical properties become homogeneous through elimination of a variation of the mechanical properties between sites the H-shape steel and, at the same time, the grains can be refined to improve the impact property. The difference in the structure between the steel of the present invention and the comparative steel is shown in FIG. 4. As is apparent from the drawing, the fillet portion of the conventional steel has a structure composed mainly of bainite, while in that of the steel of the present invention, the structure is converted to a mixed structure comprised of ferrite in a fine grain form (wherein the term "fine grain" used herein is intended to mean a fine grain specified in ASTM Nos. 6 to 8) and bainite.

This is also true of the weld heat affected zone (hereinafter referred to as "HAZ"). Specifically, HAZ is heated to a temperature just below the melting point of iron, and the austenite is significantly coarsened, which leads to coarsening of the structure, so that the toughness is significantly lowered. Since the compound oxide precipitate dispersed in the steel according to the present invention has an excellent capability of forming an acicular intragranular ferrite the heat stability is excellent in the HAZ portion and an improvement in the toughness can be attained by virtue of the formation of an intragranular ferrite structure using the compound oxide particle as a nucleus during cooling of the weld to significantly refine the structure.

The reason for limitation of constituent features of the steel of the present invention claimed in the present application will now be described.

At the outset, C is added as an ingredient useful for improving the strength of the steel. When the C content is less than 0.04%, the strength necessary for use as a structural steel cannot be provided. On the other hand, the addition of C in an excessive amount of more than 0.20% significantly deteriorates the toughness of the base material, weld cracking resistance, HAZ toughness, etc. For this reason, the upper limit of the C content is 0.20%.

Si is necessary for ensuring the strength of the base material, attaining predeoxidation and attaining other purposes. When the Si content exceeds 0.5%, a high carbon martensite, which is a hard structure, is formed within the structure, so that the toughness is significantly lowered. On the other hand, when it is less than 0.05%, no necessary Si-based oxide is formed, the Si content is limited to 0.05 to 0.5%.

Mn should be added in an amount of 0.4% or more for the purpose of ensuring the toughness. The upper limit of the Mn content is 2.0% from the viewpoint of allowable toughness and cracking resistance at welds.

N is an element that is very important to the precipitation of V(C, N) and TiN. When the N content is 0.003% or less, the amount of precipitation of TiN and V(C, N) is insufficient, so that the amount of formation of the ferrite structure is unsatisfactory. Further, in this case, it is also impossible to ensure the strength at a high temperature of 600° C. For this reason, the N content is limited to more than 0.003%. When the content exceeds 0.015%, the toughness of the base material deteriorates, which gives rise to surface cracking of the steel slab during continuous casting, so the N content is limited to 0.015% or less.

V precipitates as V(C, N), has a capability of nucleating an intragranular ferrite and is necessary for refining the ferrite and ensuring the high-temperature strength. When V is contained in an amount of less than 0.04%, it cannot precipitate as V(C, N), so that the above-described effects cannot be attained. However, the addition of V in an amount exceeding 0.2% causes the amount of precipitation of V(C, N) to become excessive, which lowers the toughness of the base material and the toughness of the weld. That the V content is thus limited to 0.05 to 0.2%.

Mo is an element that is useful for ensuring the strength of the base material and the high-temperature strength. When the Mo content is less than 0.3%, no satisfactory high-temperature strength can be ensured even by the action of a combination of Mo with the precipitation strengthening of V(C, N). On the other hand, when the Mo content exceeds 0.7%, since the hardenability is excessively enhanced, the toughness of the base material and the HAZ toughness deteriorate. Thus the Mo content is limited to 0.3 to 0.7%.

Ti serves as a deoxidizing material to form an Ti-based oxide and can advantageously accelerate the formation of an intragranular ferrite during rolling. Further, it precipitates as TiN to refine austenite, which contributes to an improvement in the toughness of the base material and welds. For this reason, when the Ti content of the steel is 0.005% or less, the Ti content of the oxide becomes so insufficient that the action of the oxide as a nucleus for forming an intragranular ferrite is lowered, so that the Ti content is limited to 0.005% or more. When the Ti content exceeds 0.025%, excess Ti forms TiC and gives rise to precipitation hardening, which remarkably lowers the toughness of the weld heat affected zone, so that it is limited to less than 0.025%. In this connection, the reason why the Ti content [Ti %] should satisfy the relationship with the dissolved oxygen concentration [O %] in terms of % by weight represented by the formula: $-0.006 \leqq [Ti\ \%] - 2[O\ \%] \leqq 0.008$ is as follows. In this formula, when the Ti content is excessively larger than the [O] concentration in terms of % by weight, excessive Ti forms TiN in a larger amount than needed, which is detrimental to the cast slab resistance and toughness of the base material. On the other hand, when the Ti content is excessively smaller than the [O] concentration in terms of % by weight, the number of the Ti-based oxide particles serving as nuclei for intragranular ferrite cannot exceed the 20 particles/$mm^2$ necessary in the present invention. Thus, the above-described limitation was provided. The reason why the number of oxide particles is limited to 20 particles/$mm^2$ or more resides in that when the number of oxide particles is less than 20 particles/$mm^2$, the number of intragranular ferrite nuclei formed is reduced, so that it becomes impossible to refine the ferrite. The number of particles was measured and specified with an X-ray microanalyzer.

Al has a strong deoxidizing power, and when it is contained in an amount exceeding 0.005%, it combines with oxygen in a solid solution form to form alumina, so that the necessary Ti-based oxide cannot be formed. For this reason, the Al content is limited to less than 0.005%.

The content of P and S contained as unavoidable impurities is not particularly limited. Since, however, they give rise to weld cracking, a lowering in the toughness and other unfavorable phenomena due to solidification segregation, they should be reduced as much as possible. The P and S contents are each desirably less than 0.02%.

The above-described elements constitute basic ingredients of the steel of the present invention. The steel of the present invention may further contain at least one member selected from Cr, Nb, Ni, Oa, Ca and REM for the purpose of enhancing the strength of the base material and improving the toughness of the base material.

Cr is useful for strengthening the base material and improving the high-temperature strength. Since, however, the addition thereof in an excessive amount is detrimental to the toughness and hardenability, the upper limit of the Cr content is 0.7%.

Nb is useful for increasing the toughness of the base material. Since, however, the addition thereof in an excessive amount is detrimental to the toughness and hardenability, the upper limit of the Nb content is less than 0.05%.

Ni is an element very useful for enhancing the toughness of the base material. Since the addition thereof in an amount of 1.0% or more increases the cost of the alloy and is therefore not profitable, the upper limit of the Ni content is 1.0%.

Cu is an element useful for strengthening the base material and attaining the weather resistance. The upper limit of the Cu content is 1.0% from the viewpoint of temper brittleness, weld cracking and hot working cracking derived from stress relaxation annealing.

Ca and REM are added for the purpose of preventing UST defects and a reduction in the toughness caused by the stretching of NLnS during hot rolling. They form Ca—O—S or REM—O—S, having a low high-temperature deformability, instead of MnS and can regulate the property and shape of inclusions as opposed to MnS. When Ca and REM are added in respective amounts exceeding 0.003% by weight and 0.01% by weight, Ca—O—S and REM—O—S are formed in large amounts and become coarse inclusions, which deteriorates the toughness of the base material and welds, so that the Ca and REM contents are limited to 0.003% or less and 0.01% or less, respectively.

The molten steel comprising the above-described ingredients is then subjected to a predeoxidation treatment to regulate the dissolved oxygen concentration. The regulation of the dissolved oxygen concentration is very important for purifying the molten metal and, at the same time, dispersing a fine oxide in the cast slab. The reason why the dissolved oxygen concentration is regulated in the range of from 0.003 to 0.015% by weight is that when the [O] concentration after the completion of the predeoxidation is less than 0.003%, the amount of the compound oxide as a nucleus for forming an intragranular ferrite, which accelerates an intragranular ferrite transformation, is reduced and grains cannot be refined, so that no improvement in the toughness can be attained. On the other hand, When the [O] concentration exceeds 0.015%, the oxide is coarsened even when other requirements are satisfied, and becomes an origin of brittle fracture and lowers the toughness. For this reason, the [O] concentration after the completion of the predeoxidation is limited to 0.003 to 0.015% by weight.

The predeoxidation treatment is effected by vacuum degassing and deoxidation withal and Si. This is because the vacuum degassing treatment directly removes oxygen contained in the molten steel in the form of a gas and CO gas and al and Si are very effective for purifying the molten steel by virtue of easy floating and removal of oxide-based inclusions formed by the strong deoxidizing agents Al and Si.

The cast slab containing a Ti-based oxide and subjected to the above-described treatment is then reheated to a temperature region of from 1,100° to 1,300° C. The reason why the reheating temperature is limited to this temperature range is as follows. In the production of a shape steel by hot working, heating to 1,100° C. or above is necessary for the purpose of facilitating plastic deformation and, in order to increase the yield point at a high temperature by V and MO, these elements should be dissolved in a solid solution form, so that the lower limit of the reheating temperature is 1,100° C. The upper limit of the reheating temperature is 1,300° C. from the viewpoint of the performance of a heating furnace and profitability.

The heated cast slab is roll-shaped by the steps of rough rolling, intermediate rolling and finish rolling. In the process according to the present invention, the steps of rolling are characterized in that, in an intermediate rolling mill between rolling passes, cooling of the surface layer portion of the cast slab to 700° C. or below followed by hot rolling in the process of recurrence of the surface of the steel is effected once or more times in the step of intermediate rolling. This step is effected for the purpose of imparting a temperature gradient from the surface layer portion towards the interior of the steel slab by the water cooling between passes to enable the working to penetrate into the interior of the steel even under low rolling reduction conditions and, at the same time, shortening the waiting time between passes caused by low-temperature rolling to increase the efficiency. The number of repetitions of water cooling and recurrent rolling depends upon the thickness of the intended rolled steel product, for example, the thickness of the flange in the case of an H-shape steel, and when the thickness is large, this step is effected a plurality of times. The reason why the temperature to which the surface layer portion of the steel slab is cooled is limited to 700° C. or below is that, since accelerated cooling is effected following rolling, the cooling from the usual $\gamma$ temperature region causes the surface layer portion to be hardened to form a hard phase, which deteriorates the workability. Specifically, in the case of cooling to 700° C. or below, since the $\gamma/\alpha$ transformation temperature is once broken and the temperature of the surface layer portion increases due to recurrence by the time the next rolling is effected, the working is effected in a low temperature $\gamma$ or $\gamma/\alpha$ two-phase coexistent temperature region, which contributes to a significant reduction in the hardenability and the prevention of hardening of the surface layer derived from accelerated cooling.

After the completion of the rolling, the steel is cooled to 650° to 400° C. at a cooling rate of 1° to 30° C. per sec. for the purpose of suppressing the grain growth of the ferrite and increasing the proportion of the bainite structure to attain the target strength in a low alloy steel. The reason why the accelerated cooling is stopped at 650° to 400° C. is as follows. If the accelerated cooling is stopped at a temperature exceeding 650° C., the temperature is the $Ar_1$ point or above and the $\gamma$ phase partly remains, so that it becomes impossible to suppress the grain growth of the ferrite and increase the proportion of the bainite structure. For this reason, the temperature at which the accelerated cooling is stopped is limited to 650° C. or below. If the accelerated cooling is effected until the temperature reaches below 400° C., in the subsequent step of standing, C and N dissolved in the ferrite phase in a supersaturated solid solution form cannot be precipitated as a carbide and a nitride, so that the ductility of the ferrite phase lowers. Thus, the temperature at which the accelerated cooling is stopped is limited to the above-described temperature range.

EXAMPLE

Figure 5:
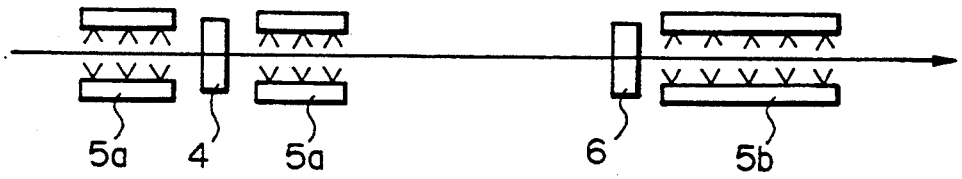
FIG. 5 is a schematic diagram of the layout of an apparatus for practicing the process of the present invention.

An H-shape steel was prepared on an experimental basis by preparing a steel by a melt process, adding an alloy thereto, subjecting the steel to a predeoxidation treatment, measuring the oxygen concentration of the molten steel, adding Ti in an amount corresponding to the amount of the oxygen, subjecting the steel to continuous casting to prepare a cast slab having a thickness of 250 to 300 mm and subjecting the cast slab to rough rolling and universal rolling as shown in FIG. 5. Water cooling between rolling passes was effected by repetition of spray cooling of the internal and external surfaces of the flange with 5*a* before and behind an intermediate universal rolling mill 4 and reverse rolling, and accelerated cooling after the completion of the rolling was effected by spray-cooling the flange and web with 5*b* behind a finish rolling mill 6.

Figure 6:
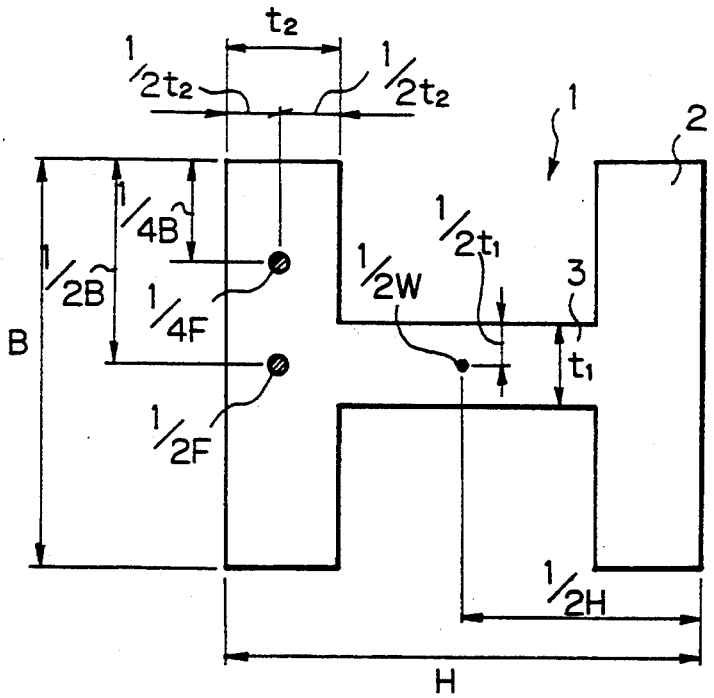
FIG. 6 is a diagram showing a sectional form and a sampling position for a mechanical test piece of an H-shape steel.

Test pieces were sampled from positions of $\frac{1}{4}$ and $\frac{1}{2}$ of the whole width length (B) (i.e., $\frac{1}{4}$B and $\frac{1}{2}$B) at the center of the sheet thickness, $t_2$, (i.e., $\frac{1}{2}t_2$) of the flange 2 shown in FIG. 6 and a position of $\frac{1}{2}$ of the height, H, of the web (i.e., $\frac{1}{2}$H) at the center of sheet thickness of the web 3. The reason why properties of these places are determined is that $\frac{1}{4}$F portion of the flange and $\frac{1}{2}$w portion of the web have respective average mechanical properties of the flange portion and web portion, and in the $\frac{1}{2}$F portion of the flange, the mechanical properties become the lowest, so that these three places represent mechanical test properties of the H-shape steel.

Table 1 shows the percentage chemical composition and the number of particles of a composite precipitate in steels on an experimental basis, and Table 2 shows rolling and accelerated cooling conditions together with mechanical test properties. The reason why the heating temperature in the rolling was 1,280° C. for all the samples is as follows. It is generally known that a lowering in the heating temperature improves the mechanical properties, and high-temperature heating conditions are considered to provide the lowest values of mechanical properties, so that these lowest values can represent properties at lower heating temperatures.

TABLE 1

(wt. %)

| Steel | | | C | Si | Mn | V | N | Al | P | S |
|---|---|---|---|---|---|---|---|---|---|---|
| Steel of Invention | 490 steel | 1 | 0.18 | 0.23 | 0.41 | 0.04 | 0.014 | 0.004 | 0.012 | 0.006 |
| | | 2 | 0.08 | 0.15 | 1.11 | 0.08 | 0.007 | 0.002 | 0.008 | 0.004 |
| | | 3 | 0.08 | 0.08 | 1.30 | 0.07 | 0.008 | 0.004 | 0.008 | 0.002 |
| | 570 steel | 4 | 0.04 | 0.12 | 1.85 | 0.04 | 0.004 | 0.003 | 0.008 | 0.005 |
| | | 5 | 0.06 | 0.11 | 1.40 | 0.07 | 0.007 | 0.003 | 0.007 | 0.004 |

TABLE 1-continued

| | | | | | | | | | | |
|---|---|---|---|---|---|---|---|---|---|---|
| | | | | | (wt. %) | | | | | |
| | | 6 | 0.05 | 0.11 | 1.26 | 0.08 | 0.008 | 0.004 | 0.006 | 0.002 |
| Comp. | 490 | 7 | 0.11 | 0.28 | 1.17 | — | 0.004 | 0.029 | 0.012 | 0.006 |
| Steel | steel | 8 | 0.11 | 0.31 | 1.22 | 0.05 | 0.004 | 0.030 | 0.013 | 0.006 |
| | 570 steel | 9 | 0.12 | 0.31 | 1.45 | 0.04 | 0.004 | 0.029 | 0.010 | 0.005 |

| Steel | | | Mo | Nb | Ni | Cu | Cr | REM | Ca | O | Ti | [O] Concentration after Pre-deoxidation | [Ti]-2 × [O] | Number of particles of Composite Precipitate ($mm^{-2}$) |
|---|---|---|---|---|---|---|---|---|---|---|---|---|---|---|
| Steel of Invention | 490 steel | 1 | 0.31 | — | — | — | — | — | — | 0.0053 | 0.023 | 0.0143 | −0.006 | 62 |
| | | 2 | 0.47 | — | — | — | — | — | — | 0.0033 | 0.012 | 0.0045 | 0.003 | 31 |
| | | 3 | 0.54 | — | — | — | — | — | 0.0025 | 0.0035 | 0.009 | 0.0049 | −0.001 | 24 |
| | 570 steel | 4 | 0.51 | 0.04 | — | — | — | — | — | 0.0032 | 0.015 | 0.0034 | 0.008 | 41 |
| | | 5 | 0.55 | 0.01 | 0.3 | 0.3 | 0.2 | — | — | 0.0030 | 0.005 | 0.0041 | −0.003 | 28 |
| | | 6 | 0.66 | 0.01 | 0.5 | 0.5 | 0.3 | 0.007 | — | 0.0034 | 0.011 | 0.0049 | 0.001 | 54 |
| Comp. Steel | 490 steel | 7 | 0.51 | 0.02 | — | — | 0.5 | — | — | 0.0018 | 0.013 | — | — | 0 |
| | | 8 | 0.52 | 0.02 | — | — | 0.5 | — | — | 0.0015 | 0.012 | — | — | 0 |
| | 570 steel | 9 | 0.54 | 0.03 | 0.5 | 0.5 | 0.3 | — | — | 0.0016 | 0.013 | — | — | 0 |

As is apparent from Table 2, steels 1 to 6 according to the present invention sufficiently satisfy the target high-temperature strength and base material strength requirement at 600° C. (the above-described JISG3106) and a charpy value of 47 (J) or more at −5° C. On the other hand, in comparative steels 7, 8 and 9, since the conventional Al deoxidation is effected without adopting dispersion of a fine oxide by regulation of the oxygen concentration of the molten steel and addition of Ti, and no accelerated cooling treatment is effected during and after rolling, although the room temperature strength and high temperature strength of the base material satisfy the requirement for buildings and the YP ratio is 0.8 or less, the refinement of the structure and low alloy cannot be attained, so that the toughness lowers and, in particular, the toughness of the portion of ½ width in the ½ sheet thickness of the flange does not satisfy the target value. In the present invention, the phenomenon wherein the surface layer portion of the flange is hardened by the accelerated cooling treatment after the completion of the rolling to reduce the workability, is prevented by refinement of $\gamma$ by water cooling between rolling passes, and the surface hardness of the outer side surface satisfies a target Vickers hardness, Hv, of 240 or less.

That is, when all the requirements of the present invention are satisfied, like the shape sheets 1 to 6 listed in Table 2, it becomes possible to produce rolled shape steels excellent in fire resistance and toughness and having sufficient strength at room temperature and 600° C. even at a position of ½ width in ½ sheet thickness of the flange where it is most difficult to satisfy mechanical property requirements of the rolled shape steel. It is a matter of course that the rolled shape steel contemplated in the present invention is not limited to the H-shape steel described in the above Example but includes I shape steels, angles, channels and irregular unequal thickness angles.

In the rolled shape steel of the present invention, sufficient strength and toughness can be attained even at the portion of ½ width in the ½ sheet thickness of the flange where it is most difficult to ensure the mechanical test properties, and it becomes possible to effect efficient in-line production of controlled coldrolled shape steels having excellent fire resistance and toughness and capable of attaining the fireproof property even when the high temperature property and covering thickness of the refractory material are 20 to 50% of the prior art, which contributes to a significant reduction of the cost by virtue of a reduction in the construction cost and shortening of the construction period, so that industrial effects, such as improvements in the reliability, safety and profitability of large construction, are very significant.

TABLE 2

| Steel | | | Size of H-Shape Steel mm | Water Cooling between Rolling Passes | Number of Times of Water Cooling to 700° C. or below + Rolling | Site | Water Cooling after Rolling: Initiation temp., °C. | Water Cooling after Rolling: Termination temp., °C. | Cooling rate between 800° C. and 650° C., °C./sec |
|---|---|---|---|---|---|---|---|---|---|
| Steel of Invention | 490 class steel | 1 | H800 × 300 × 14/26 | Done | 1 | ¼F | 805 | 620 | 9 |
| | | | | | | ½F | — | — | 7 |
| | | | | | | ½W | 800 | 640 | 11 |
| | | 2 | H438 × 417 × 30/40 | Done | 2 | ¼F | 850 | 550 | 5 |
| | | | | | | ½F | — | — | 3.5 |
| | | | | | | ½W | 835 | 540 | 7 |
| | | 3 | H538 × 447 × 60/90 | Done | 3 | ¼F | 870 | 550 | 2.5 |
| | | | | | | ½F | — | — | 1.5 |
| | | | | | | ½W | 830 | 540 | 3.5 |
| | 570 class steel | 4 | H800 × 300 × 14/26 | Done | 2 | ¼F | 800 | 405 | 14 |
| | | | | | | ½F | — | — | 11 |
| | | | | | | ½W | 780 | 410 | 26 |

TABLE 2-continued

| | | | | | | | | | |
|---|---|---|---|---|---|---|---|---|---|
| | | 5 | H438 × 417 × 30/40 | Done | 3 | ¼F | 830 | 500 | 6 |
| | | | | | | ½F | — | — | 4 |
| | | | | | | ½W | 810 | 520 | 8 |
| | | 6 | H538 × 447 × 60/90 | Done | 4 | ¼F | 860 | 500 | 3.1 |
| | | | | | | ½F | — | — | 1.6 |
| | | | | | | ½W | 840 | 510 | 4.0 |
| Comp. Steel | 490 class steel | 7 | H800 × 300 × 14/26 | Not done | 0 | ¼F | Not done | Air cooling | 0.5 |
| | | | | | | ½F | | | 0.3 |
| | | | | | | ½W | | | 0.9 |
| | | 8 | H438 × 417 × 30/40 | Not done | 0 | ¼F | Not done | Air cooling | 0.2 |
| | | | | | | ½F | | | 0.1 |
| | | | | | | ½W | | | 0.3 |
| | 570 class steel | 9 | H800 × 300 × 14/26 | Not done | 0 | ¼F | Not done | Air cooling | 0.5 |
| | | | | | | ½F | | | 0.3 |
| | | | | | | ½W | | | 0.8 |

| | | | Mechanical Test Properties of Base Material at Each Site | | | | | | |
|---|---|---|---|---|---|---|---|---|---|
| | | | Strength at room temp. (N/mm²) | | High-temp. strength at 600° C. (N/mm²) | | | Charpy test, vE_5 (J) (average value) | Hardness of Outer Surface of Flange (Hv) |
| | Steel | | YP | TS | YP | TS | High-temp. YP/room temp. YP | | |
| Steel of Invention | 490 class steel | 1 | 387 | 558 | 271 | 340 | 0.70 | 276 | — |
| | | | 363 | 547 | 261 | 345 | 0.72 | 280 | 198 |
| | | | 399 | 568 | 280 | 364 | 0.70 | 241 | — |
| | | 2 | 391 | 577 | 281 | 367 | 0.72 | 290 | — |
| | | | 372 | 552 | 263 | 349 | 0.71 | 263 | 203 |
| | | | 388 | 584 | 275 | 357 | 0.71 | 292 | — |
| | | 3 | 347 | 531 | 248 | 332 | 0.71 | 265 | — |
| | | | 331 | 528 | 239 | 320 | 0.72 | 233 | 195 |
| | | | 355 | 542 | 251 | 339 | 0.70 | 284 | |
| | 570 class steel | 4 | 474 | 619 | 341 | 415 | 0.72 | 273 | — |
| | | | 465 | 607 | 328 | 398 | 0.71 | 230 | 229 |
| | | | 499 | 624 | 350 | 421 | 0.70 | 266 | — |
| | | 5 | 462 | 583 | 330 | 403 | 0.71 | 287 | — |
| | | | 470 | 601 | 334 | 399 | 0.71 | 246 | 205 |
| | | | 487 | 611 | 342 | 410 | 0.70 | 254 | — |
| | | 6 | 455 | 591 | 326 | 392 | 0.72 | 219 | — |
| | | | 449 | 589 | 316 | 379 | 0.70 | 220 | 218 |
| | | | 473 | 609 | 338 | 405 | 0.71 | 289 | — |
| Comp. Steel | 490 class steel | 7 | 341 | 499 | 240 | 317 | 0.70 | 145 | — |
| | | | 355 | 511 | 251 | 327 | 0.70 | 30 | 167 |
| | | | 361 | 520 | 253 | 330 | 0.70 | 189 | — |
| | | 8 | 328 | 501 | 235 | 316 | 0.72 | 72 | — |
| | | | 317 | 472 | 229 | 311 | 0.72 | 21 | 174 |
| | | | 359 | 536 | 255 | 331 | 0.71 | 100 | — |
| | 570 class steel | 9 | 475 | 637 | 335 | 399 | 0.70 | 39 | — |
| | | | 490 | 626 | 351 | 427 | 0.72 | 15 | 202 |
| | | | 495 | 648 | 349 | 431 | 0.71 | 46 | — |

We claim:

1. A process for producing a controlled rolling shape steel, having excellent fire resistance and toughness, comprising the steps of: subjecting a molten steel comprising, in terms of % by weight, 0.04 to 0.20% of C, 0.05 to 0.50% of Si, 0.4 to 2.0% of Mn, 0.3 to 0.7% of Mo, 0.003 to 0.015% of N, 0.04 to 0.20% of V and less than 0.005% of Al, with the balance consisting of Fe and unavoidable impurities, to a predeoxidation treatment to regulate dissolved oxygen in the molten steel to a concentration of 0.003 to 0.015% by weight, adding titanium so as to produce a titanium content of 0.005 to 0.025% by weight and to satisfy a requirement of the relationship between the titanium content (Ti %) and the dissolved oxygen concentration (O %) represented by the formula: $-0.006 \leqq (\text{Ti } \%) - 2(\text{O } \%) \leqq 0.008$, to crystallize a titanium-based oxide in an amount of 20 particles/mm² or more, depositing MnS,TiN, and V(C,N) on the titanium-based oxide, during cooling, to disperse the titanium-based oxide as a composite precipitate in the steel, thereby producing a cast slab, reheating the cast slab to a temperature region of from 1,100° to 1,300° C., then initiating rolling to provide a rolled steel slab having a surface and a surface layer portion, effecting between passes in the step of rolling at least once water-cooling of the surface layer portion of the resultant rolled steel slab to 700° C. or below followed by rolling in the process of recurrent rolling of the surface of the rolled steel slab, cooling the rolled steel slab after the completion of the rolling at a cooling rate of 1° to 30° C./sec to 650° to 400° C. and then allowing the cooled rolled steel slab to stand.

2. A process for producing a controlled rolling shape steel, having excellent fire resistance and toughness, comprising the steps of: subjecting a molten steel comprising, in terms of % by weight, 0.04 to 0.20% of C, 0.05 to 0.05% of Si, 0.4 to 2.0% of Mn, 0.3 to 0.7% of Mo, 0.003 to 0.015% of N, 0.04 to 0.20% of V and less than 0.005% of Al and further comprising at least one member selected from 0.7% or less of Cr, 0.05% or less of Nb, 1.0% or less of Ni, 1.0% or less of Cu, 0.003% or less of Ca and 0.010% or less of REM with the balance consisting of Fe and unavoidable impurities, to a predeoxidation treatment to regulate dissolved oxygen in the molten steel to a concentration of 0.003 to 0.015% by weight, adding titanium so as to produce a titanium content of 0.005 to 0.025% by weight and to satisfy a requirement of the relationship between the titanium content (Ti %) and the dissolved oxygen concentration (O %) represented by the formula: $-0.006 \leqq (Ti\ \%) - 2(O\ \%) \leqq 0.008$, to crystallize a titanium-based oxide in an amount of 20 particles/$mm^2$ or more, depositing MnS,TiN, and V(C,N) on the titanium-based oxide, during cooling, to disperse the titanium-based oxide as a composite precipitate in the steel, thereby producing a cast slab, reheating the cast slab to a temperature region of from 1,100° to 1,300° C., then initiating rolling to provide a rolled steel slab having a surface and a surface layer portion, effecting between passes in the step of rolling at least once water-cooling of the surface layer portion of the resultant rolled steel slab to 700° C. or below followed by rolling in the process of recurrent rolling of the surface of the rolled steel slab, cooling the rolled steel slab after the completion of the rolling at a cooling rate of 1° to 30° C./sec to 650° to 400° C. and then allowing the cooled rolled steel slab to stand.

* * * * *

UNITED STATES PATENT AND TRADEMARK OFFICE

CERTIFICATE OF CORRECTION

PATENT NO. : 5,421,920

DATED : June 6, 1995

INVENTOR(S) : Kohichi YAMAMOTO, et al.

It is certified that error appears in the above-indentified patent and that said Letters Patent is hereby corrected as shown below:

Column 1, line 22, change "aNew" to --"New--.

Column 2, line 46, change "-0.0006" to --0.006--.

Column 3, line 21, change "O %]" to --[O %]--.

Column 3, line 57, before "0.008," insert --≦--.

Column 8, line 8, change "Oa" to --Cu--.

Column 8, line 67, change "withal" to --with A1--.

Column 9, line 2, change "al" to --A1--.

Signed and Sealed this

Nineteenth Day of September, 1995

*Attest:*

Bruce Lehman

BRUCE LEHMAN

*Attesting Officer*

*Commissioner of Patents and Trademarks*